US010179724B2

(12) United States Patent
Kaup et al.

(10) Patent No.: US 10,179,724 B2
(45) Date of Patent: Jan. 15, 2019

(54) ADD-ON DEVICE TO BE ATTACHED TO A LIFTING VEHICLE, AND METHOD FOR ACTUATING SAID ADD-ON DEVICE

(71) Applicant: KAUP GMBH & CO KG, Aschaffenburg (DE)

(72) Inventors: Otmar Kaup, Aschaffenburg (DE); Markus Unkelbach, Erlenbach am Main (DE)

(73) Assignee: KAUP GmbH & Co. KG, Aschaffenburg (DE)

( * ) Notice: Subject to any disclaimer, the term of this patent is extended or adjusted under 35 U.S.C. 154(b) by 88 days.

(21) Appl. No.: 15/327,028

(22) PCT Filed: May 14, 2015

(86) PCT No.: PCT/DE2015/000232

§ 371 (c)(1),
(2) Date: Jan. 17, 2017

(87) PCT Pub. No.: WO2015/172763

PCT Pub. Date: Nov. 19, 2015

(65) Prior Publication Data

US 2017/0183209 A1 Jun. 29, 2017

(30) Foreign Application Priority Data

May 14, 2014 (DE) ..... 10 2014 006 970

(51) Int. Cl.

| | |
|---|---|
| ***B66F 9/06*** | (2006.01) |
| ***B66F 9/10*** | (2006.01) |
| ***B66F 9/14*** | (2006.01) |

(52) U.S. Cl.
CPC ..... *B66F 9/143* (2013.01); *B66F 9/144* (2013.01)

(58) Field of Classification Search
CPC ..... B66F 9/143; B66F 9/144
(Continued)

(56) References Cited

U.S. PATENT DOCUMENTS 3,589,541 A * 6/1971 Melin ..... B66F 9/12 414/630
4,381,166 A * 4/1983 Smart ..... B66F 9/143 414/667

(Continued)

OTHER PUBLICATIONS

US 2009/0116945 A1, White et al., May 7, 2009.*
US 2013/0189064 A1, Matti, Jul. 25, 2013.*

*Primary Examiner* — Douglas A Hess
(74) *Attorney, Agent, or Firm* — Michael L. Greenberg, Esq.; Greenberg & Lieberman, LLC

(57) ABSTRACT

Add-on device (1) to be attached to a lifting vehicle, having a movable fork arm unit (2) comprising at least one fork arm (3), having at least two units (4) for driving a lateral movement of the fork arm unit (2), in particular each comprising at least one drive chain (6), in particular running in opposite directions, wherein the drive chain (6) is in particular assigned to a respective fork arm (3), having in each case at least one hydraulic motor (11), by which the unit can be driven, wherein the hydraulic motors (11) of two units (4) can be connected in parallel for a lateral movement of the fork arms (3) in the same direction and/or the hydraulic motors (11) of two units (4) can be connected in series for a lateral movement of the fork arms (3) in opposite directions. Method for actuating said add-on device (1).

9 Claims, 4 Drawing Sheets

Figure 1:
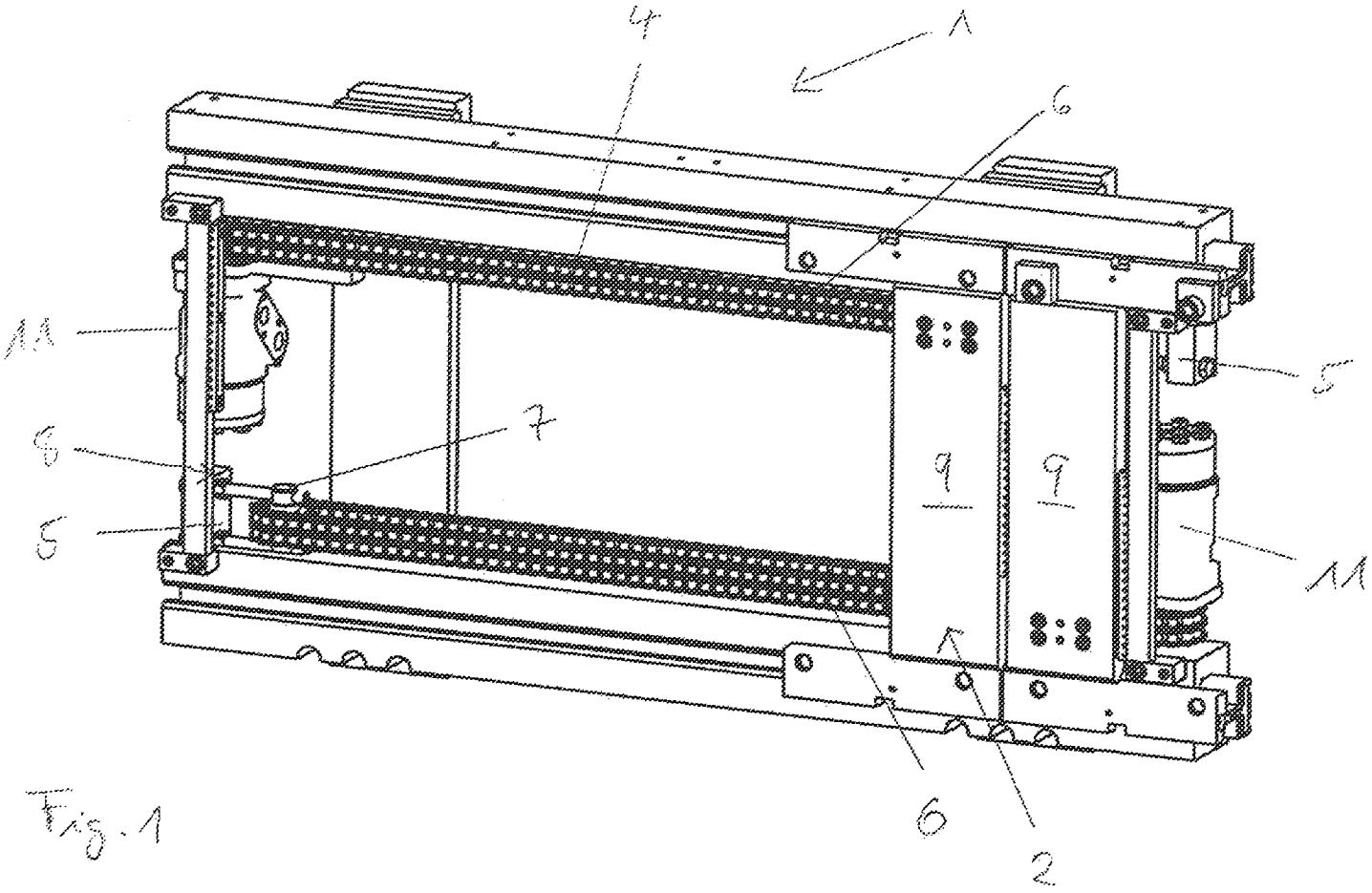

(58) Field of Classification Search
USPC ..... 414/662, 663, 664, 667, 668, 671
See application file for complete search history.

(56) References Cited

U.S. PATENT DOCUMENTS 4,392,772 A * 7/1983 Reeves ..... B66F 9/144
414/667
4,395,188 A * 7/1983 Kaup ..... B66F 9/125
414/622
5,096,363 A * 3/1992 Weinert ..... B66F 9/143
414/667
5,338,148 A * 8/1994 Ronnblonn ..... B66F 9/143
414/667
5,688,102 A * 11/1997 Vieselmeyer ..... A01G 23/043
414/666
6,969,225 B2 * 11/2005 Mensch ..... B66F 9/065
187/237
7,967,545 B2 * 6/2011 Lauvdal ..... B66F 9/18
414/607
8,075,243 B2 * 12/2011 Chilson ..... B60L 15/2036
180/167
8,087,868 B2 * 1/2012 Turnbull ..... B66F 9/148
414/659
9,617,132 B2 * 4/2017 Iotti ..... B66F 9/143

* cited by examiner

ADD-ON DEVICE TO BE ATTACHED TO A LIFTING VEHICLE, AND METHOD FOR ACTUATING SAID ADD-ON DEVICE

The invention relates to an attachment device, that is to be mounted on a lifting vehicle, and a method for actuating an attachment device.

It is known to provide cylinder drives for fork of attachment devices for lifting vehicles that have the disadvantage that they require a large depth of the construction volume.

The problem of the invention is to provide an attachment device, that avoid the disadvantages of the prior art and provide a safe and reliable attachment device.

Said problem is solved by means of an attachment device, which is to be attached to a lifting vehicle, with a movable fork apparatus comprising at least one fork, with at least two devices for driving of a lateral movement of the fork apparatus, in particular each comprising at least one driving chain, in particular arranged for opposite movement, wherein the said driving chain is in particular associated with one fork respectively, each with at least one oil motor, with which the device is to be driven, wherein for a lateral rectified movement of the forks the oil motors of two devices can be arranged in a parallel connection and/or for a lateral oppositely directed adjustment of the forks the oil motors of two devices can be arranged in a series connection.

The attachment device makes it possible to obtain a compact operation method, that is for the driver of the lifting vehicle a particularly clear-cut operation method, as the attachment device has a larger field of view without interfering elements. In addition, depending on the connection of the oil motors a change in the force or the torque of the oil motors are achieved. The attachment device does not move during the adjustment of the forks and thus a close approximation, of for example a lateral container wall is easily possible.

It is advantageous if in series connection of the oil motors a valve for limiting the pressure built-up in the oil motors is provided arranged in particular in the lifting vehicle.

It is advantageous if in a parallel connection of the oil motors a hydraulic end switch for the oil motors is provided respectively.

It is advantageous if the oil motors are inserted in the opposite direction, since by the inverted arrangement, with respect to the direction of rotation of the motor, an extremely compact, space-saving design is achieved.

It is advantageous if the device has at least one tensioning device, comprising at least one hydraulic piston, which is acted on by oil of the oil motor, which is associated with the fork, through which the driving chain is to be held at a predetermined tension, wherein in particular the device is associated with a deflection roller, on which the driving chain is deflected and which is stretched by the hydraulic piston.

It is advantageous if a longitudinal transport device for longitudinal transport of goods is provided arranged along at least one fork, wherein the longitudinal transport device in particular comprises a transport chain, wherein in particular a tensioning device with a hydraulic piston is provided for tensioning the transport chain actuated by the oil in the oil motor, wherein the longitudinal transport device, is in particular connectible by means of a solenoid valve.

It is advantageous if the fork is designed be extended as a telescopic fork. Different load depths can be achieved by the length adjustment of the fork.

It is advantageous if the hydraulic piston is a plunger cylinder, wherein the tension of the device is to be held by pressure force of the plunger cylinder and/or the hydraulic piston is a differential cylinder, wherein the tension of the device is to be held by tensile force of the differential cylinder. It is advantageous if the pressure generated in the hydraulic piston is held by a pressure-holding device, in particular a non-return valve.

It is advantageous if a pre-tensioning valve is provided in front of at least one hydraulic piston, wherein in particular the pre-loading valve is provided in combination with a non-return valve.

It is advantageous if a pressure limiting valve is provided, via the oil from the hydraulic piston can escape, in particular in the case of a damage.

The problem is also solved by means of a method for actuating an attachment device, which is to be attached to a lifting vehicle, with a movable fork apparatus comprising at least two forks, with at least two devices by which a lateral movement of the fork apparatus is driven, in particular each comprising at least one driving chain, in particular arranged for opposite movement, wherein the said driving chain is in particular associated with one fork respectively, each with at least one oil motor, with which the device is driven, wherein for a lateral rectified movement of the forks the oil motors of two devices are arranged in a parallel connection and/or for a lateral oppositely directed adjustment of the forks the oil motors of two devices are arranged in a series connection.

It is advantageous if in series connection of the oil motors a valve arranged in particular in the lifting vehicle limits the built-up pressure in the oil motors and/or in a parallel connection of the oil motors a hydraulic end switch respectively switches off the oil motors in the end position.

It is advantageous if the oil motors are installed in opposite directions.

It is advantageous if the driving chain after a predetermined longitudinal elongation, in particular due to use, is shortened by an adapted predetermined length.

Further characteristics and advantages of said invention arise from the claims and the following description, in the embodiments of the object of the invention in connection with the drawings are explained in more detail.

It is shown in

Figure 2:
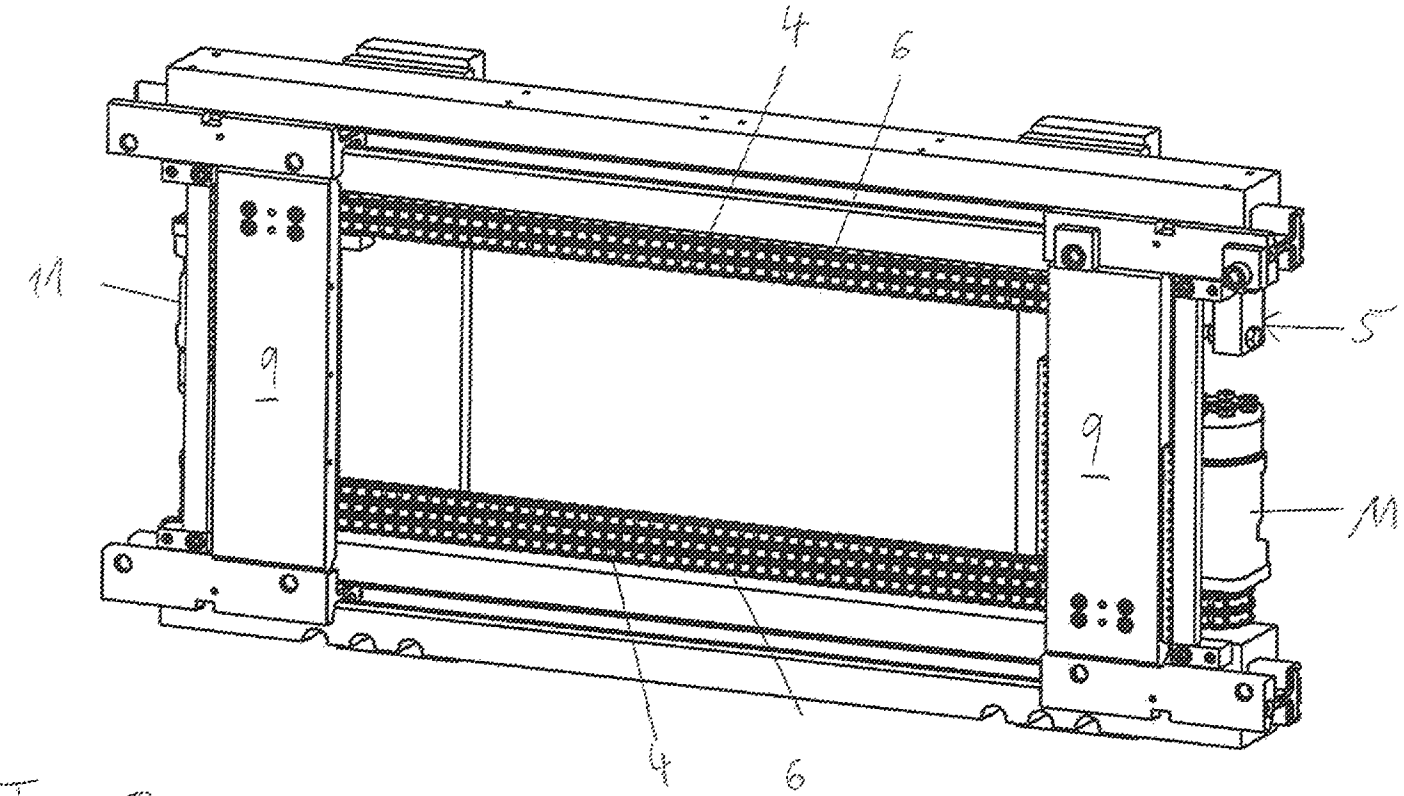
Figure 3:
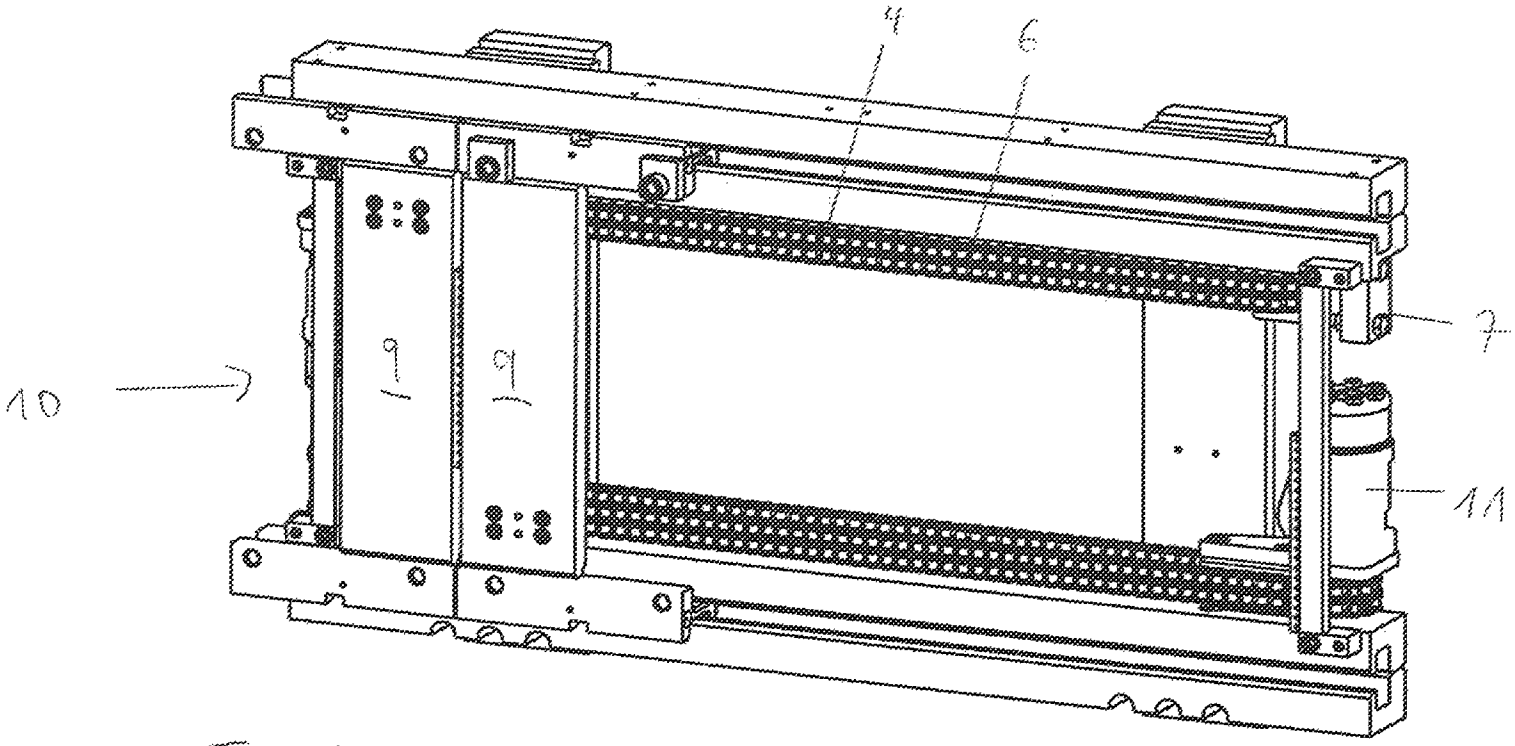

FIG. 1 an attachment device with drive chains in perspective view,

FIG. 2 an attachment device with drive chains in perspective view,

FIG. 3 an attachment device with drive chains in perspective view and

Figure 4:
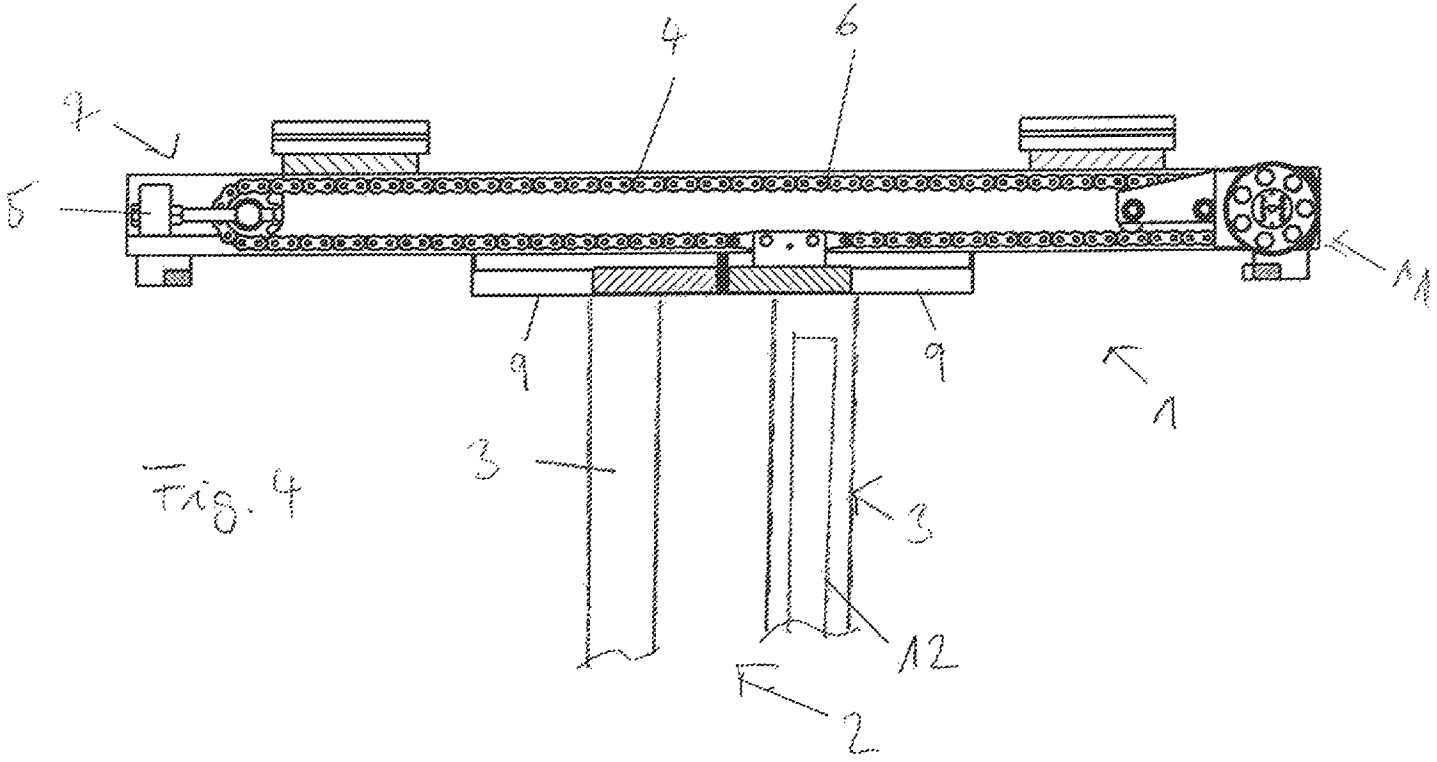

FIG. 4 an attachment device with drive chain in plan view.

FIG. 1 shows an attachment device 1, which is to be attached to a lifting vehicle, comprising drive chains 6 in perspective view. The attachment device 1 has, for example, two arrays of driving chains 6, two adjacent and synchronously respectively. On these double-arranged driving chains 6 retaining devices 9 for a movable fork apparatus 2 are arranged, in particular each comprising at least one fork prong, as shown in FIG. 4.

The driving chains 6 are exemplary devices 4 for driving for a lateral movement of the fork apparatus 2, wherein the driving chain 6 is in particular related to a fork respectively, represented by their holding device 9, each having at least one oil motor 11, by which the device 4 to be driven, wherein for a lateral rectified movement of the forks the oil motors 11 of two devices 4 can be set up in a parallel connection and/or for a lateral oppositely directed adjustment of the forks the oil motors 11 of two devices 4 can be set up in a series connection.

The two oil motors 11 are inserted for example in the opposite direction with respect to a direction of rotation of the oil motor 11, whereby a very compact construction form is achieved.

The device has at least one tensioning device 5, comprising at least one hydraulic piston 8, which is acted on by the oil of the oil motor 11, which is associated to the holding device 9 of the fork, by means of which the driving chain 6 is to be held on a preset tension, wherein in particular the device 4 is assigned with a deflection roller device 7, on which the driving chain 6 is to be deflected and which is to be tensioned by the hydraulic piston 8.

The attachment device in FIG. 1 shows an end-side, rectified position of the holding devices 9.

FIG. 2 shows an attachment device 1 with driving chains 6 of a device 4 in perspective view. The attachment device 1 has an end-side, opposite position of the holding devices 9.

FIG. 3 shows an attachment device with driving chains in perspective view. The attachment device in FIG. 1 has relative to FIG. 1 at an opposite end stop 10 arranged end-sided, rectified position of the holding devices 9.

FIG. 4 shows an attachment device 1 with driving chain 6 in plan view. FIG. 4 shows an attachment device 1 comprising a fork apparatus 2 on holding devices 9 with at least one fork 3. A fork 3 for example has a longitudinal transport device 4 for example in the form of a toothed belt. The transporting movement is achieved, for example, by the oil motor 11.

REFERENCE CHARACTER LIST

1 attachment device
2 fork apparatus
3 fork
4 device
5 tensioning device
6 driving chain
7 deflection roller installation
8 hydraulic piston
9 holding device
10 end stop
11 oil motor
12 longitudinal transport device

We claim:

1. Attachment device (1), which is to be attached to a lifting vehicle, with a movable fork apparatus (2) comprising at least one fork (3), with at least two devices (4) for driving of a lateral movement of the fork apparatus (2), in particular each comprising at least one driving chain (6), in particular arranged for opposite movement, wherein the said driving chain is in particular associated with one fork (3) respectively, each with at least one oil motor (11), with which the device is to be driven, wherein for a lateral rectified movement of the forks (3) the oil motors (11) of two devices (4) can be arranged in a parallel connection and/or for a lateral oppositely directed adjustment of the forks (3) the oil motors (11) of two devices (4) can be arranged in a series connection; and wherein characterized by that in series connection of the oil motors (11) a valve is provided for limiting the pressure built-up in the oil motors (11) arranged in particular in the lifting vehicle.

2. Attachment device according to claim 1, characterized by that in parallel connections of the oils motors (11) an hydraulic end-switch for the oil motors is provided.

3. Attachment device according to claim 1, characterized by that the device (4) has at least one tensioning device (5), comprising at least one hydraulic piston (8), which is acted on by oil of the oil motor (11), which is associated with the fork (3), through which the driving chain (6) is to be held at a predetermined tension, wherein in particular the device (4) is associated with a deflection roller (7), on which the driving chain (6) is deflected and which is stretched by the hydraulic piston (8).

4. Attachment device according to claim 1, characterized by that the hydraulic piston is a plunger cylinder, wherein the tension of the device is to be held by pressure force of the plunger cylinder and/or the hydraulic piston is a differential cylinder, wherein the tension of the device is to be held by tensile force of the differential cylinder.

5. Attachment device according to claim 1, characterized by that the pressure generated in the hydraulic piston (8) is held by a pressure-holding device, in particular a non-return valve.

6. Attachment device according to claim 1, characterized by that a pre-tensioning valve is provided in front of at least one hydraulic piston (8) , wherein in particular the preloading valve is provided in combination with a non-return valve.

7. Attachment device according to claim 1, characterized by that a pressure limiting valve is provided, via the oil from the hydraulic piston (8) can escape, in particular in the case of a damage.

8. Attachment device (1), which is to be attached to a lifting vehicle, with a movable fork apparatus (2) comprising at least one fork (3), with at least two devices (4) for driving of a lateral movement of the fork apparatus (2), in particular each comprising at least one driving chain (6), in particular arranged for opposite movement, wherein the said driving chain is in particular associated with one fork (3) respectively, each with at least one oil motor (11), with which the device is to be driven, wherein for a lateral rectified movement of the forks (3) the oil motors (11) of two devices (4) can be arranged in a parallel connection and/or for a lateral oppositely directed adjustment of the forks (3) the oil motors (11) of two devices (4) can be arranged in a series connection; and characterized by that a longitudinal transport device for longitudinal transport of goods is provided arranged along at least one fork (3), wherein the longitudinal transport device in particular comprises a transport chain, wherein in particular a tensioning device (5) with a hydraulic piston (8) is provided for tensioning the transport chain actuated by the oil in the oil motor (11), wherein the longitudinal transport device, is in particular connectible by means of a solenoid valve.

9. Method for actuating an attachment device (1), which is to be attached to a lifting vehicle, with a movable fork apparatus (2) comprising at least two forks (3), with at least two devices (4) by which a lateral movement of the fork apparatus (2) is driven, in particular each comprising at least one driving chain (6), in particular arranged for opposite movement, wherein the said driving chain is in particular associated with one fork (3) respectively, each with at least one oil motor (11), with which the device is driven, wherein for a lateral rectified movement of the forks (3) the oil motors (11) of two devices (4) are arranged in a parallel connection and/or for a lateral oppositely directed adjustment of the forks (3) the oil motors (11) of two devices (4) are arranged in a series connection; and characterized in that in series connection of the oil motors (11) a valve arranged in particular in the lifting vehicle limits the built-up pressure in the oil motors (11) and/or in a parallel connection of the oil motors (11) a hydraulic end switch respectively switches off the oil motors (11) in the end position.

* * * * *